US008605926B2

(12) United States Patent
Nikles et al.

(10) Patent No.: US 8,605,926 B2
(45) Date of Patent: Dec. 10, 2013

(54) SEALING UNIT WITH COMPONENT MOUNT FOR A HEARING APPARATUS

(75) Inventors: Peter Nikles, Erlangen (DE); Erika Radick, Nürnberg (DE); Benjamin Schmidt, Nürnberg (DE); Christian Schmitt, Grossenseebach (DE); Erwin Singer, Eckental (DE); Cornelia Wiedenbrüg, Spardorf (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 1329 days.

(21) Appl. No.: 12/214,150

(22) Filed: Jun. 17, 2008

(65) Prior Publication Data

US 2008/0317271 A1 Dec. 25, 2008

(30) Foreign Application Priority Data

Jun. 20, 2007 (DE) ..... 10 2007 028 232

(51) Int. Cl.
*H04R 25/00* (2006.01)

(52) U.S. Cl.
USPC ..... 381/323

(58) Field of Classification Search
USPC ..... 381/322
See application file for complete search history.

(56) References Cited

U.S. PATENT DOCUMENTS

| | | | | |
|---|---|---|---|---|
| 3,496,306 | A * | 2/1970 | Pollak | 381/328 |
| 6,748,093 | B2 | 6/2004 | Topholm | |
| 7,260,233 | B2 * | 8/2007 | Svendsen et al. | 381/322 |
| 2002/0136421 | A1 | 9/2002 | Topholm | |
| 2002/0198437 | A1 | 12/2002 | Juneau et al. | |
| 2003/0123687 | A1 * | 7/2003 | Petrick et al. | 381/322 |
| 2007/0047750 | A1 * | 3/2007 | Sauer et al. | 381/324 |

FOREIGN PATENT DOCUMENTS

| | | | |
|---|---|---|---|
| DE | 2005 040 542 | B3 | 4/2007 |
| DE | 102005040542 | B3 | 4/2007 |
| EP | 0629101 | A1 | 12/1994 |
| EP | 1 246 507 | A1 | 10/2002 |

* cited by examiner

*Primary Examiner* — Anthony Ho

(57) ABSTRACT

The production of sealing units, and especially of face plates for hearing devices and other hearing apparatuses, is to be further automated. A sealing unit for sealing a shell of a hearing apparatus that can be worn in the auditory canal is accordingly proposed, with a face plate having a battery opening for holding a battery, with battery contacts, to which at least one signal processing module is connected, being arranged in or on the battery opening. A mount is removably affixed in or on the battery opening in order to hold the at least one signal processing module in or perpendicularly above/below the battery opening. The mount thus serves not only to retain the signal processing components during transport, but also to affix them into the face plate for example during milling of positioning holes for microphones.

12 Claims, 2 Drawing Sheets

SEALING UNIT WITH COMPONENT MOUNT FOR A HEARING APPARATUS

CROSS REFERENCE TO RELATED APPLICATIONS

This application claims priority of German application No. 10 2007 028 232.1 filed Jun. 20, 2007, which is incorporated by reference herein in its entirety.

FIELD OF THE INVENTION

The present invention relates to a sealing unit for sealing a shell of a hearing apparatus that can be worn in the auditory canal with a face plate having a battery opening for holding a battery, with battery contacts, to which at least one signal processing module is connected, being arranged in or on the battery opening. Hearing apparatus is understood here to mean a device that can be worn on the ear in particular a hearing device, a headset, a set of ear phones and the like.

BACKGROUND OF THE INVENTION

Hearing devices are wearable hearing apparatuses which are used to assist the hard-of-hearing. In order to accommodate numerous individual requirements, various types of hearing devices are available such as behind-the-ear (BTE) hearing devices and in-the-ear (ITE) hearing devices, for example also concha hearing devices or completely-in-the-canal (ITE, CIC) hearing devices. The hearing devices listed as examples are worn on the outer ear or in the auditory canal. Bone conduction hearing aids, implantable or vibrotactile hearing aids are also available on the market. The damaged hearing is thus stimulated either mechanically or electrically.

The key components of hearing devices are principally an input converter, an amplifier and an output converter. The input converter is normally a receiving transducer e.g. a microphone and/or an electromagnetic receiver, e.g. an induction coil. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear bearing device. One or a plurality of microphones 2 for recording ambient sound are built into a hearing device housing 1 to be worn behind the ear. A signal processing unit 3 which is also integrated into the hearing device housing 1 processes and amplifies the microphone signals. The output signal for the signal processing unit 3 is transmitted to a loudspeaker or receiver 4, which outputs an acoustic signal. Sound is transmitted through a sound tube, which is affixed in the auditory canal by means of an otoplastic, to the device wearer's eardrum. Power for the hearing device and in particular for the signal processing unit 3 is supplied by means of a battery 5 which is also integrated in the hearing device housing 1.

An ITE hearing device and/or a CIC hearing device usually comprises a shell and a so-called face plate that seals the shell and thus represents a sealing unit. The hearing device shell and/or the shell of the hearing apparatus is inserted into the user's auditory canal and therefore must be individually shaped. As a result the shell is normally produced in the user's country of residence. By contrast the face plate can be regarded as a standard element in its basic form (null face plate). Consequently it is normally produced at a common production location for all countries. This frequently brings benefits in terms of costs, logistics and quality.

During production the null face plate is fitted with the standard components that are practically always required for the model being produced. Thus for example battery and programming contacts are inserted and/or injected into the face plate at this stage. Furthermore a hybrid circuit for example, on to which various electronic components are soldered, is cold-welded on to the battery and/or programming contacts at the production location of the face plate. The hybrid circuit is mostly positioned together with at least one microphone in freely-milled openings at typical specific points on the face plate.

However during the milling process the signal processing components that have already been soldered and/or welded on to the null face plate cannot be located in the milling zone. As this is indeed normally the case, the mechanical production of individual face plates is not currently possible. Currently only the amplifier circuit and the volume control are usually affixed to the null face plate and the individualization of the face plate, i.e. the positioning holes are milled manually.

A hearing device that can be worn in the ear is known from the publication EP 1 246 507 A1. It features a face plate on to which a socket is removably fixed in a battery opening. An electronic module is positioned on the socket. In order to remove electronic components from the hearing device the socket is removed from the battery opening. An in-the-ear hearing device with an electronic module is furthermore described in the patent specification DE 10 2005 040 542 B3. The electronic module is inserted into a housing shell and the electronic components of the electronic module are affixed to a flexible skeleton.

SUMMARY OF THE INVENTION

The object of the present invention is thus to further automate the production of hearing apparatuses with shells that can be worn in the auditory canal.

This object is inventively achieved by means of a sealing unit for sealing a shell of a hearing apparatus that can be worn in the auditory canal with a face plate having a battery opening for holding a battery, with battery contacts, to which at least one signal processing module is connected, being arranged in or on the battery opening, and with a mount being removably affixed in or on the battery opening in order to hold the at least one signal processing module in or perpendicularly above/below the battery opening in a non-final assembly position.

The signal processing modules, which are already affixed to the null face plate but not yet finally positioned at the production location of the null face plate, can advantageously be held in a defined position by the mount. Thus it is possible at the production location to perform a standardized functionality test after soldering. In this way it is possible with a high degree of certainty to guarantee that the local production site for individualizing the face plate receives a fully functioning system. The null face plate can now be individualized for example by means of special positioning holes only here in this production site that is close to the user, for example in the production site for the shell. These positioning holes determine for example the position of the microphones and/or the operating controls desired by the user. These holes are milled into the null face plate using highly specialized milling machines. In this way a high and consistent level of quality can be achieved.

A further advantage of the inventive mount in the sealing unit or face plate is that the signal processing modules are protected by the mount during transport. However the greatest advantage is that the signal processing modules and circuits that are accommodated in the mount are not damaged during the milling process, since they are located in the area of the battery opening where no positioning holes are to be milled anyway.

According to a special embodiment the mount is snapped into place in the battery opening. The mechanical stress placed on the battery opening by the mount is entirely unproblematic.

However the sealing unit can also have a fixing element for affixing a battery opening cover so that the mount can alternatively be affixed to the fixing element. A further alternative is that the mount is affixed to at least one of the battery contacts. Furthermore if one or several programming contacts are provided in/on the sealing unit, the mount can also be affixed to these programming contacts. Thus in principle all parts of the sealing unit in/on the battery opening can be used to removably affix the mount.

The mount can hold a hybrid circuit, for example. It can alternatively or additionally also hold one or several microphones in a desired position. It is thus possible to securely position the key signal processing components, which are already fitted to the null face plate at the location where it is produced, for further working.

The mount can additionally be fitted into, and can have essentially the lateral measurements of, the battery opening. In this case the mount is directly inserted into the battery opening so that the entire interior volume of the battery opening can be used for the protection of components.

BRIEF DESCRIPTION OF THE DRAWINGS

The present invention is described in more detail with reference to the appended drawings, in which.

DETAILED DESCRIPTION OF THE INVENTION

The exemplary embodiment shown in more detail below represents a preferred embodiment of the present invention.

Figure 1:
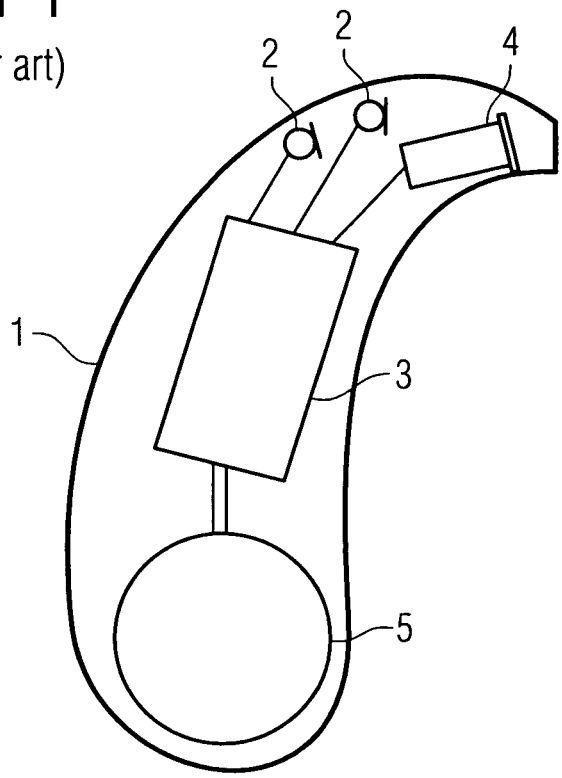
FIG 1 (Prior art)
FIG. 1 shows a basic configuration of a hearing device with its key components according to the prior art.
Figure 2:
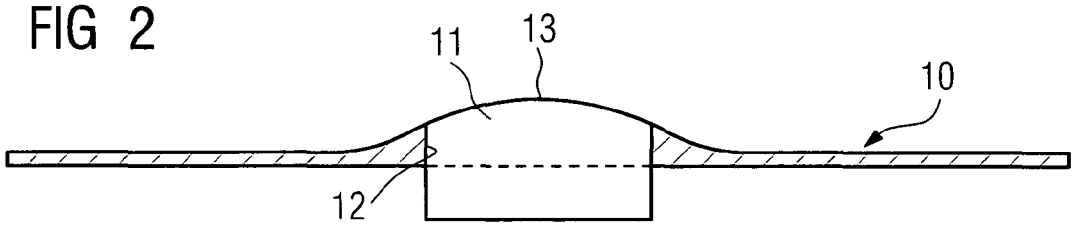
FIG. 2 shows a lateral view of a face plate according to the invention, including a mount.

FIG. 2 shows a so-called null face plate 10 from the side. Its final measurements are not yet fixed and it does not yet have any positioning holes for microphones, operating controls and the like. It only has a so-called dome at its center, said dome serving to provide increased space specifically in ITE hearing devices and/or CIC hearing devices. This is because the hearing device battery is located under the dome 11 when the hearing device is fully assembled. A battery opening 12 is provided in the dome 11 through which a battery can be inserted into and/or removed from the hearing device.

A mount 13 made of metal or plastic is inserted into the battery opening 12. Viewed from the side the mount has an approximately rectangular shape, with the upper surface being arched like the dome 11. As a result the interior volume of the mount is also increased. The mount 13 is affixed in the battery opening 12 by snap-on elements for example (not shown in FIG. 2). However the mount 13 can also be removably held in or on the battery opening 12 on battery contacts or programming contacts. In principle the mount 13 can be affixed in/on the battery opening 12 by means of any technique such as latching, plugging, screwing and the like.

Figure 3:
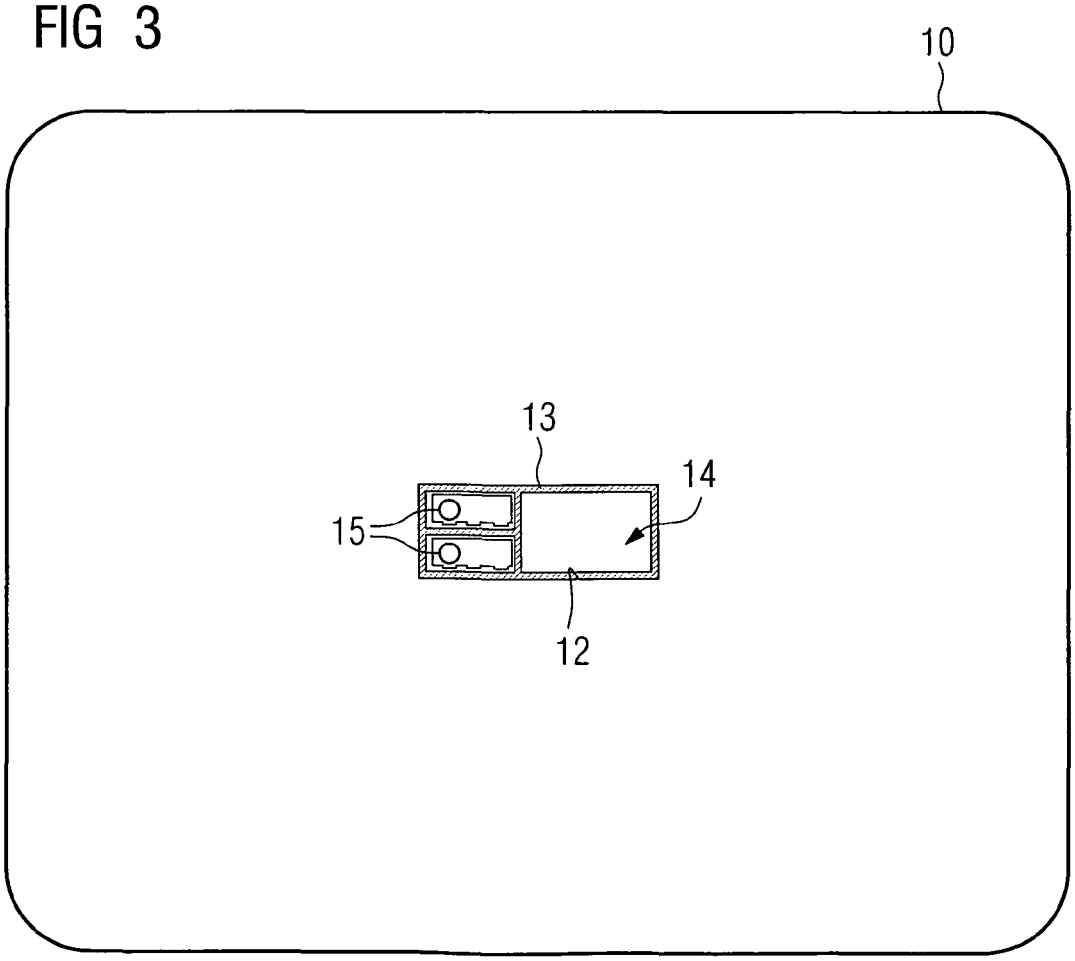
FIG. 3 shows a plan view of the face plate of FIG. 2.

FIG. 3 shows a plan view of the null face plate 10. The rectangular battery opening 12, into which the mount 13 is inserted with a precise fit, is located at the center. This means that the mount 13 has the same shape as the battery opening 12 in the plan view shown here.

The mount 13 has three compartments here. An amplifier circuit 14, typically a hybrid circuit, is accommodated in one compartment. Two microphones 15 are inserted into the other compartments. The microphones 15 are soldered on to the amplifier circuit 14 with electrical cables (not shown). The corresponding cables are likewise accommodated in the mount 13. In turn the amplifier circuit 14 is cold-welded via corresponding cables on to battery contacts, which are also not shown in the figures and which are located directly at the battery opening on the lower surface of the face plate 10. The mount 13 accordingly serves to retain not only the signal processing components 14 and 15, but also their cabling, during transport.

Production of the null face plate 10 takes place as follows at a central production location: firstly all the electronic components that are provided are soldered on to the amplifier circuit 14 and/or the hybrid and cold-welded on to the battery and programming contacts. Subsequently or prior to this the special mount 13 is inserted into the battery opening and the signal processing components, here the amplifier circuit 14 and the microphones 15, are latched in, plugged in or affixed by some other means to the mount 13. The null face plate is now ready for transport and further working.

At the production site for individualization of the face plate, individual holes are now milled into the null face plate. Since the signal processing components in the mount 13 that are electrically connected to the face plate are located in the battery opening or directly on the battery opening, neither they nor the corresponding cables are damaged during the milling process. Also the components need not be manually held in a special position so the entire milling process can be automated. After milling the signal processing components are removed from the mount and the mount is removed from the battery hole. Finally the signal processing components are bonded in or to the newly milled holes. Thus the individualization of the face plate, insofar as it relates to the mounting of components, is complete.

The invention claimed is:

1. A sealing unit for sealing a shell of a hearing apparatus, comprising:

a face plate comprising a battery opening;

a temporary mount removably affixed in the battery opening when the face plate is in a non-final assembly position, the mount comprising at least one signal processing component;

the at least one signal processing component being held in the battery opening by the temporary mount when the face plate is in the non-final assembly position; and the battery opening configured to receive a battery of the hearing apparatus when the face plate is in a final assembly position;

wherein after transport and prior to final assembly of the face plate and assembly of the hearing apparatus, the temporary mount is removed from the battery opening and the at least one signal processing component is affixed to the face plate outside the battery opening.

2. The sealing unit as claimed in claim 1, wherein the mount is snapped into the battery opening.

3. The sealing unit as claimed in claim 1, further comprising a fixing element for affixing a battery cover and the mount is affixed to the fixing element.

4. The sealing unit as claimed in claim 1, further comprising a programming contact and the mount is affixed to the programming contact.

5. The sealing unit as claimed in claim 1, wherein the mount is affixed to the battery contact.

6. The sealing unit as claimed in claim 1, wherein a hybrid circuit of the hearing apparatus is held by the mount.

7. The sealing unit as claimed in claim 1, wherein a microphone of the hearing apparatus is held by the mount.

8. The sealing unit as claimed in claim 1, wherein the mount has a lateral measurement a size of the battery opening and is fitted into the battery opening.

9. The sealing unit as claimed in claim 1, wherein a battery contact is arranged in the battery opening or on the battery opening.

10. The sealing unit as claimed in claim 1, wherein the mount is removably affixed in the battery opening or on the battery opening.

11. The sealing unit as claimed in claim 1, wherein the at least one signal processing component is held in the battery opening, or perpendicularly above the battery opening, or perpendicularly below the battery opening.

12. A sealing unit for sealing a shell of a hearing apparatus, comprising:

a face plate having a battery opening;

a temporary mount removably affixed in an area of the battery opening when the sealing unit is in a non-final assembly configuration;

a signal processing component accommodated in the battery opening by the temporary mount when in the non-final assembly configuration for protection of the signal processing component during transport of the sealing unit and during a milling process wherein a hole is milled into the face plate prior to final assembly of the hearing apparatus;

the signal processing component removable from the temporary mount and the temporary mount removable from the battery opening in a final assembly confiauration, when the signal processing component is bonded in or to the hole.

* * * * *